US009468079B2

(12) United States Patent
Sorokin et al.

(10) Patent No.: US 9,468,079 B2
(45) Date of Patent: Oct. 11, 2016

(54) LIGHTING SYSTEM AND A METHOD FOR DETERMINING THE ENERGY CONSUMPTION OF A LIGHTING SYSTEM

(75) Inventors: Mikhail Victorovich Sorokin, Eindhoven (NL); Johanna Cornelia Maria Francisca Tielens, Deurne (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1238 days.

(21) Appl. No.: 13/386,488

(22) PCT Filed: Jul. 19, 2010

(86) PCT No.: PCT/IB2010/053271
§ 371 (c)(1),
(2), (4) Date: Mar. 16, 2012

(87) PCT Pub. No.: WO2011/010271
PCT Pub. Date: Jan. 27, 2011

(65) Prior Publication Data

US 2012/0176067 A1 Jul. 12, 2012

(30) Foreign Application Priority Data

Jul. 24, 2009 (EP) ..... 09166369

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
CPC ..... *H05B 37/029* (2013.01)

(58) Field of Classification Search
USPC ..... 315/312–326, 362
See application file for complete search history.

(56) References Cited

U.S. PATENT DOCUMENTS

| | | | | |
|---|---|---|---|---|
| 4,980,806 | A * | 12/1990 | Taylor et al. | 362/85 |
| 5,812,422 | A * | 9/1998 | Lyons | 703/18 |
| 8,842,009 | B2 * | 9/2014 | Jones | 340/541 |
| 2004/0002792 | A1 | 1/2004 | Hoffknecht | |
| 2004/0160199 | A1 | 8/2004 | Morgan et al. | |
| 2006/0273741 | A1 | 12/2006 | Stalker, III | |

(Continued)

FOREIGN PATENT DOCUMENTS

| | | | |
|---|---|---|---|
| CN | 1949949 | A | 4/2007 |
| WO | 2007127978 | A2 | 11/2007 |
| WO | 2008074213 | A1 | 6/2008 |
| WO | 2009066234 | A2 | 5/2009 |

OTHER PUBLICATIONS

Dunne, R., "A renewable energy and energy efficiency programme in a state primary school", 2009, p. 1, http://www.jhspowersolutions.co.uk/downloads/Awards%201.pdf.

*Primary Examiner* — Brandon S Cole
(74) *Attorney, Agent, or Firm* — Meenakshy Chakravorty

(57) ABSTRACT

The invention relates to the creation of lighting programs or scenes with a lighting system taking energy consumption into account. An embodiment of the invention provides a lighting system (10) comprising—a first database (12) containing data of the luminairies (14) of the lighting system, —a second database (16) containing information for lighting presets of the luminairies of the lighting system for a lighting scene to be created, and—a calculation module (18) being adapted to calculate the energy consumption of the lighting system based on a lighting scene to be created depending on data retrieved from the first and the second database.

11 Claims, 2 Drawing Sheets

(56) References Cited

U.S. PATENT DOCUMENTS

2007/0061050 A1* 3/2007 Hoffknecht ..... 700/291
2009/0243517 A1* 10/2009 Verfuerth et al. ..... 315/315
2010/0060185 A1* 3/2010 Van Duijneveldt ..... 315/287
2010/0328284 A1* 12/2010 Noguchi ..... 345/207
2012/0235579 A1* 9/2012 Chemel et al. ..... 315/152

* cited by examiner

LIGHTING SYSTEM AND A METHOD FOR DETERMINING THE ENERGY CONSUMPTION OF A LIGHTING SYSTEM

FIELD OF THE INVENTION

The invention relates to the creation of lighting programs or scenes with a lighting system taking energy consumption into account.

BACKGROUND OF THE INVENTION

Modern lighting systems enable users to set different lighting scenes, such as selecting a preferred lighting color or a dynamic lighting. Lighting scenes may be created by professional lighting designers, or by users themselves. A lighting scene comprises presets of the lamps to render the desired lighting scene. Users may control a lighting system by selecting a desired lighting scene to be rendered by means of a user interface. Several lighting scenes can be combined to a lighting program like a playlist. Users may then select a certain lighting program fitting their individual lighting wishes With the increasing opportunities with new control systems for lighting systems the number of offered presets is growing, so keeping in mind what buttons on a user interface of a lighting system do what becomes increasingly tricky. Thus, there exists a need for an advanced assistance of users for using a lighting system, particularly when users want to create certain lighting scenes or programs with a lighting system.

SUMMARY OF THE INVENTION

It is an object of the invention to provide a system and a method for an improved creating of lighting scenes or programs with a lighting system.

The object is solved by the subject matter of the independent claims. Further embodiments are shown by the dependent claims.

A basic idea of the invention is to improve the creating of lighting scenes with a lighting system by taking the energy consumption into account. While most lighting allow to adjust presets of lighting scenes, energy aspects are usually not considered. With the invention, energy consumption may be automatically considered when a lighting scene is selected for rendering by a user.

An embodiment of the invention provides a lighting system comprising

- a first database containing data of the luminairies of the lighting system,
- a second database containing information for lighting presets of the luminairies of the lighting system for a lighting scene to be created, and
- a calculation module being adapted to calculate the energy consumption of the lighting system based on a lighting scene to be created depending on data retrieved from the first and the second database. This allows to calculate the energy consumption for each lighting scene to be created, thus allowing to improve the creation of lighting scenes with regard to energy.

The calculation module may be adapted to calculate the energy consumption by

- retrieving the data of the luminaries required for the creation of the selected lighting scene from the first database,

- retrieving the lighting presets for the selected lighting scene from the second database, and
- calculating the energy consumption from the retrieved data of luminaries and the retrieved lighting presets.

The calculating of the energy consumption from the retrieved data of luminaries and the retrieved lighting presets may comprise

- modeling the lighting system's behaviour based on the retrieved lighting presets and
- calculating an estimated energy consumption for the selected lighting scene and based on the modeling. Particularly for complex lighting systems, the modeling of the lighting system's behaviour may be an accurate method to calculate an estimated energy consumption.

The system may further comprise

- a third database containing energy costs, wherein
- the calculation module is further adapted to calculate overall energy costs of a lighting scene to be created based on the calculated energy consumption and the energy costs retrieved from the third database. Thus, also the energy costs may be taken into account, which may make the selection of a lighting scene creation by a user more comfortable.

The system may further comprise

- a lighting scene selector module being adapted to automatically select one or more lighting scenes from a set of lighting scenes depending on an energy target by calculating the energy consumption for each lighting scene and selecting each lighting scene with an energy consumption lower than or equal to the energy target. Thus, a user may set an energy target, and the system automatically tries to meet this energy target by selecting a suitable lighting scene.

The lighting scene selector module may be further adapted to automatically create a lighting program from the automatically selected lighting scenes. This enables a user also to set an energy target for a lighting program, for example for a program for one month and to meet given energy consumption or cost targets.

A further embodiment of the invention relates to a method for determining the energy consumption of a lighting system comprising

- retrieving the data of the luminaries required for the creation of a lighting scene from a first database containing data of the luminairies of the lighting system,
- retrieving the lighting presets for the lighting scene from a second database containing information for lighting presets of the luminairies of the lighting system for the lighting scene to be created, and
- calculating the energy consumption of the lighting system based on the lighting scene to be created depending on data retrieved from the first and the second database. The method may be for example implemented as an algorithm for a computer program, which may be executed by a central lighting controller.

The energy consumption may be calculated from the retrieved data of luminaries and the retrieved lighting presets.

The calculating of the energy consumption from the retrieved data of luminaries and the retrieved lighting presets may comprise

- modeling the lighting system's behaviour based on the retrieved lighting presets and
- calculating an estimated energy consumption for the selected lighting scene and based on the modeling.

The method may further comprise the act of calculating the overall energy costs of a lighting scene to be created based on the calculated energy consumption and energy costs retrieved from a third database.

The method may further comprise the act of automatically selecting one or more lighting scenes from a set of lighting scenes depending on an energy target by calculating the energy consumption for each lighting scene and selecting each lighting scene with an energy consumption lower than or equal to the energy target.

The method may further comprise the act of automatically creating a lighting program from the the automatically selected lighting scenes.

An embodiment of the invention provides a computer program enabling a processor to carry out the method according to the invention and as described above.

According to a further embodiment of the invention, a record carrier storing a computer program according to the invention may be provided, for example a CD-ROM, a DVD, a memory card, a diskette, internet memory device or a similar data carrier suitable to store the computer program for optical or electronic access.

A further embodiment of the invention provides a computer programmed to perform a method according to the invention such as a PC (Personal Computer). The computer may be applied to a lighting system as central lighting controller of the lighting system.

These and other aspects of the invention will be apparent from and elucidated with reference to the embodiments described hereinafter.

The invention will be described in more detail hereinafter with reference to exemplary embodiments. However, the invention is not limited to these exemplary embodiments.

DETAILED DESCRIPTION OF EMBODIMENTS

Figure 1:
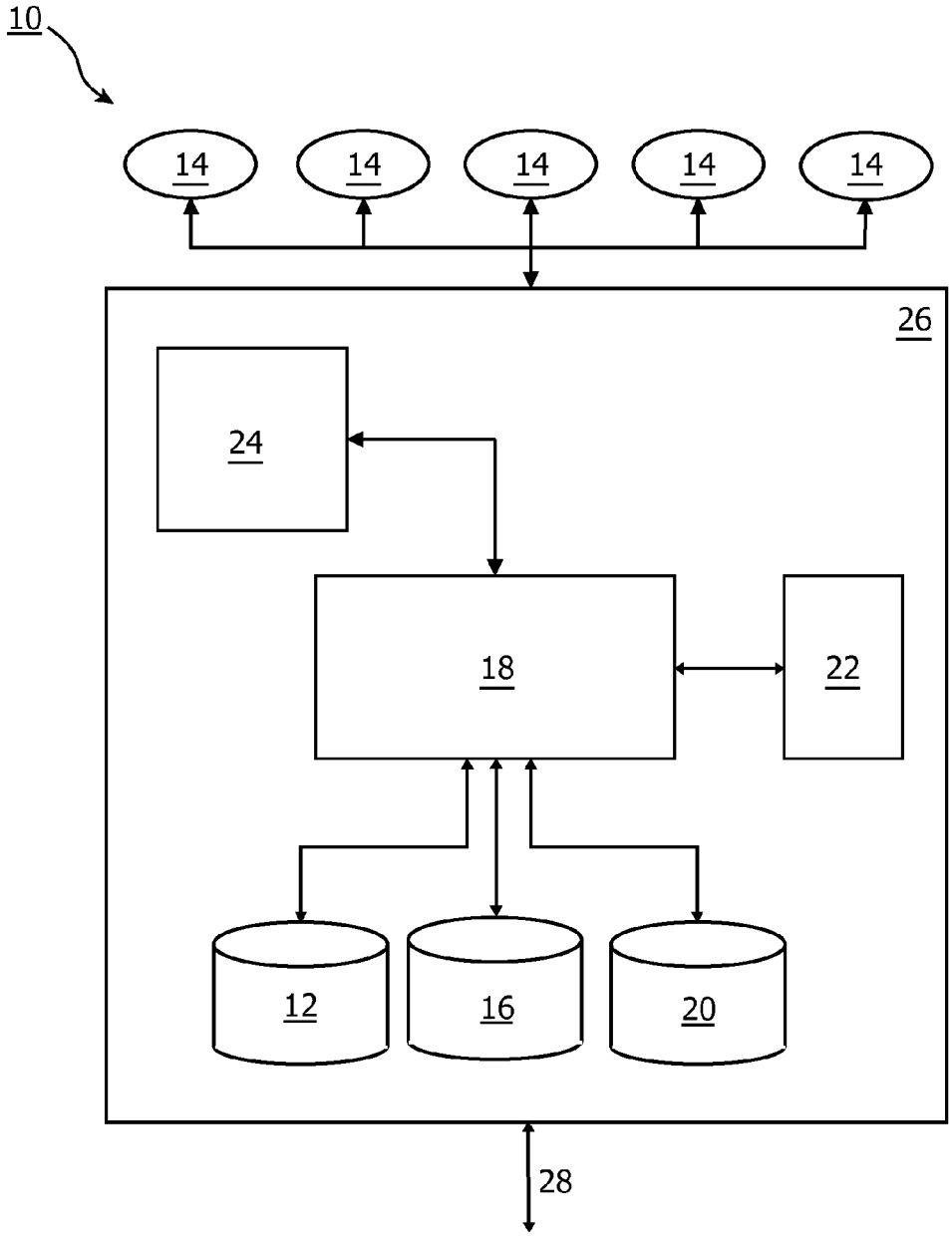
FIG. 1 an embodiment of a lighting system according to the invention.

In the following, functionally similar or identical elements may have the same reference numerals. The terms "light", "lighting unit" and "luminairy" relate in the following to the same.

FIG. 1 shows a lighting system 10 with several luminaries 14. Operation of the luminaries 14 can be controlled, for example the lighting color, the dimming level, the saturation. The luminaries 14 may contain several color LEDs (Light Emitting Diodes) for generating a colored lighting. For controlling the luminaries 14, a central lighting controller 26 is provided, which may be implemented by a standard Personal Computer (PC), which is configured by a program implementing control functionality of the luminaries, or a lighting controller comprising a processor or microcontroller, which are also configured by a program to implement the control functionality for the luminaries. The central lighting controller 26 can control one, several or all luminaries by transmitting control commands to the luminaries, or to a lighting controller (not shown), switched between the luminaries 14 and the central lighting controller 26 as a further control instance.

The central lighting controller 26 is also configured to create lighting scenes with the luminaries 14. A lighting scene contains presets of some or all luminaries 14. The presets may contain the lighting color and dimming level of the luminaries 14 in order to create a desired lighting scene. A lighting scene may be created by a user via a user interface (UI) 24 or connected to the central lighting controller. The UI 24 may be for example formed by a program executed by a mobile device such as a PDA (Personal Digital Assistant), Smartphone, laptop. The mobile device may be connected to the central lighting controller via a data connection 28, for example a LAN (Local Area Network) or WLAN. An example of a mobile device is a smartphone, which is connected to a WLAN and executes a lighting system access applet, which creates the UI 24 for the lighting system 10.

Since it is often a tedious task to create a lighting scene to be rendered with a complex lighting system, lighting scenes may also be received from for example professional lighting designers or lighting system vendors. Since lighting scenes are datasets, they may be for example downloaded by a user via the data connection 28 from a server (not shown), for example a webserver, to the central lighting controller 26.

Presets of lighting scenes (either user created or downloaded) may be stored in a preset database 16 of the lighting system controller. The presets are adapted to the instances of the concrete luminaries 14 of the lighting system 10. This is important when a user downloads a lighting scene, since the downloaded lighting scene is usually not adapted to the concrete lighting system, but contains merely an abstract description of a lighting scene, which may then be automatically transferred to the concrete lighting system 10. Systems and methods for such an automatic transfer of an abstract lighting atmosphere or scene description into a control set for an instance of a lighting system are offered by the Applicant and subject to further patent applications of the Applicant.

The central lighting controller 26 comprises a further luminaries data database 12, which contains data of the luminaries 14. The contained data particularly comprises information about the energy consumption of each luminary 14 and may contain further information such as about the functionality of each luminary 14.

A third database 20 of the central lighting controller 26 contains the actual energy costs, which may also be downloaded from a server, for example a webserver, which hosts a database with the energy costs.

It should be noted that all databases 12, 16, and 20 must not be part of the central lighting controller 26, but may be for example also offered by separate servers, for example webservers in the internet, home servers, or simple PCs acting as a kind of server for the central lighting controller 26. For example, a user may execute the databases 16 and 20 in her/his PC, which may be connected to the internet, and download new lighting scenes or update the energy costs from time to time by starting a program on her/his PC for managing the databases 16 and 20. This PC may be connected to a LAN or WLAN of the user in her/his home, to which also the central lighting controller 26 is connected in order to access the databases 16 and 20 on the PC.

Figure 2:
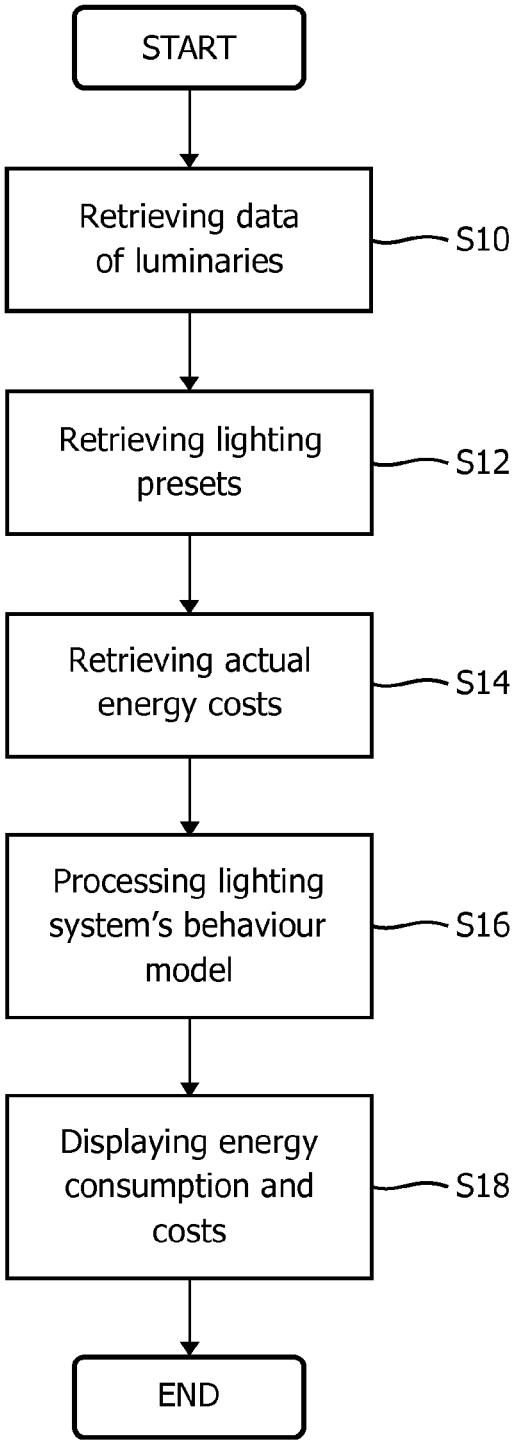
FIG. 2 an embodiment of a method for determining the energy consumption of a lighting system.

As mentioned above, the central lighting controller 26 may comprise a user interface (UI) 24. Over the UI 24, a user may control for example the creation of a lighting scene with the lighting system 10. When a user wishes to create a certain lighting scene, she/he can for example select one of the lighting scenes stored in the lighting scene database 16. After selection of a lighting scene, a calculation module 18 of the central lighting controller 26 processes the selected lighting scene according to the following algorithm, a flowchart of which is shown in FIG. 2:

The calculation module 18 retrieves the data of the luminaries required for the creation of the selected lighting scene from the first database 12 (step S10). Then, the module 18 retrieves the lighting presets for the selected lighting scene from the preset database 16 (step S12), and retrieves the actual energy costs from the energy costs database 20 (step S14).

After retrieving all of these data, the calculation module 18 begins to process a model of the lighting system's behaviour (step S16) based on the retrieved lighting presets and calculates an estimated energy consumption and the costs for the selected lighting scene based on the modeling. The behaviour model is processed based on the presets contained in the lighting scene and may take static and dynamic lighting into account. Thus, the model may be time dependent.

The result of this estimated energy consumption calculation is then displayed on the UI 24 (step S18), before the user may finally select the lighting scene for creation. When the lighting scene is created by the lighting system 10, the calculation module 18 may still work in the background and update the energy consumption and costs displayed with the UI 24.

The central lighting controller 26 is also adapted to create lighting programs with the lighting system 10. A lighting program in the context of this invention is a playlist of lighting scenes.

For example, a lighting program for an office space may comprise the following data:

| Time | Lighting scene |
|---|---|
| 12 PM-8 AM | All off |
| 8 AM-12 AM | Business lighting |
| 12 AM-7 PM | Summer lighting |
| 7 PM-8 PM | Cleaning lighting |
| 8 PM-12 PM | All off |

Another example is the following lighting program for a home:

| Time | Lighting scene |
|---|---|
| 12 PM-6 AM | All off |
| 6 AM-8 AM | Wakeup lighting |
| 8 AM-12 AM | Morning lighting |
| 12 AM-6 PM | Afternoon lighting |
| 6 PM-8 PM | Sunset lighting |
| 8 PM-11 PM | Dimmed evening lighting |
| 11 PM-12 PM | All off |

A user may also select such a lighting program via the user interface 24 with the central lighting controller 26. The calculation module 18 may then calculate the energy consumption for the selected lighting program by calculating the energy consumption for every lighting scene contained in the program as explained above. Furthermore, the calculation module 18 may calculate the energy costs by taking the time span of each lighting scene contained in the selected lighting program into account.

Additionally, a user may set an energy target, which should be met by a lighting created with the lighting system 10. Energy target may mean an energy consumption or energy cost target. The user selects via the UI 24 of the central lighting controller 26 the menu for energy target lighting creation and enters a given energy target, for example in terms of maximum energy costs or energy consumption of the lighting system. For example, a user may enter the total costs for lighting for a day, week or month. Also, the user may enter whether a lighting scene or a lighting program should be created by the lighting system 10. The inputted energy target serves as the starting point for lighting creation, as is described in the following:

The calculation module 18 communicates to a lighting scene selector module 22 the input energy target together with the inputted selection lighting scene or program. The lighting scene selector module 22 then automatically selects one or more lighting scenes from a set of lighting scenes, which are stored in the lighting system 10 or on a server accessible over the data connection 28. If the user selected a lighting scene selection, the module 22 selects only lighting scenes, which are suitable to meet the inputted energy target by calculating the energy consumption for each lighting scene and selecting each lighting scene with an energy consumption lower than or equal to the energy target. If the user selected a lighting program selection, the module 22 selects either a stored lighting program, which meets the energy target by calculating the energy consumption of a lighting program with the calculation module 18 and as described above, or the module 22 automatically selects a number of lighting scenes and creates a lighting program from the selected lighting scenes, with which the energy target may be met. For example, when a user inputted as an energy target a maximum cost amount per day and lighting program, the module 22 may automatically select suitable lighting scenes and create the lighting program in that it automatically determines for how long certain lighting scenes are active during the day in order to meet the energy target costs.

For example, when a user inputted as energy cost target 470 Euro/month for an office space, the lighting scene selector module 22 may automatically create the following playlist of lighting scenes as lighting program for a day in order to meet the energy cost target:

| Time | Lighting scene | Costsin Euro/month |
|---|---|---|
| 12 PM-8 AM | All off | 5 |
| 8 AM-1230 PM | Business lighting | 180 |
| 1230 PM-730 PM | Summer lighting | 240 |
| 730 PM-8 PM | Cleaning lighting | 40 |
| 8 PM-12 PM | All off | 5 |

Even if all lights are switched off in the times 12 PM-8 AM and 8 PM-12 PM, energy is consumed for example by the central lighting controller 26 so that the costs are not 0. Thus, the lighting system 10 offers a user also to create lighting scenes or programs by taking energy aspects into account.

Thus, the invention may improve the creation of lighting with lighting systems. The invention can be applied to all lighting system being adapted to create lighting scenes.

At least some of the functionality of the invention may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A lighting system comprising:

a plurality of luminaires, a first database containing data associated with the plurality of luminaires, a second database containing information for lighting presets for a set of lighting scenes to be created by the plurality of luminaires;

a third database containing first energy costs;

a calculation module for calculating energy consumption of the lighting system for at least one lighting scene of the set of lighting scenes to be created depending on data retrieved from the first and the second database, wherein the calculation module is configured to calculate overall energy costs of the at least one lighting scene based on the calculated energy consumption and the first energy costs, which are retrieved from the third database; and a lighting scene selector module for automatically selecting one or more lighting scenes from the set of lighting scenes depending on an energy consumption target by calculating the energy consumption for each lighting scene and selecting the one or more lighting scenes having an energy consumption lower than or equal to the energy consumption target.

2. The system of claim 1, wherein the calculation module is adapted to calculate the energy consumption by retrieving the data of the luminaires required for the creation of the selected one or more lighting scenes from the first database, retrieving the lighting presets for the selected one or more lighting scene from the second database, and calculating the energy consumption from the retrieved data of the luminaries and the retrieved lighting presets.

3. The system of claim 2, wherein the calculating of the energy consumption from the retrieved data of the luminaries and the retrieved lighting presets comprises modeling the lighting system's behavior based on the retrieved lighting presets and calculating an estimated energy consumption for the selected one or more lighting scenes based on the modeling.

4. The system of claim 1, wherein the lighting scene selector module is configured to automatically create a lighting program from the selected one or more lighting scenes.

5. A method for determining the energy consumption of a lighting system comprising a plurality of luminaires, the method comprising:

retrieving data associated with one or more luminaires required for the creation of a lighting scene from a first database containing data associated with the plurality of luminaires of the lighting system;

retrieving lighting presets for the lighting scene from a second database containing information for lighting presets of the one or more luminaires of the lighting system for the lighting scene to be created by the one or more luminaires;

calculating an energy consumption of the lighting system based on the lighting scene to be created depending on data retrieved from the first and the second database;

calculating overall energy costs of the lighting scene to be created based on the calculated energy consumption and energy costs retrieved from a third database; and automatically selecting one or more lighting scenes from a set of lighting scenes depending on an energy target using a lighting scene selector module, by calculating the energy consumption for each lighting scene and selecting each lighting scene with an energy consumption lower than or equal to the energy target consumption.

6. The method of claim 5, where the energy consumption is calculated from the retrieved data associated with the one or more luminaries and the retrieved lighting presets.

7. The method of claim 6, wherein the calculating of the energy consumption from the retrieved data associated with the one or more luminaries and the retrieved lighting presets comprises modeling the lighting system's behavior based on the retrieved lighting presets and calculating an estimated energy consumption for the selected one or more lighting scenes based on the modeling.

8. The method of claim 5, further comprising automatically creating a lighting program from the selected one or more lighting scenes.

9. A computer program enabling a processor to carry out the method according to claim 5.

10. A record carrier storing the computer program according to claim 9.

11. A computer programmed to perform a method according to claim 5.

* * * * *